US011975879B2

(12) United States Patent
Buchberger et al.

(10) Patent No.: US 11,975,879 B2
(45) Date of Patent: May 7, 2024

(54) GRIPPER CARRIAGE CONTROL

(71) Applicant: MULTIVAC SEPP HAGGENMUELLER SE & CO. KG, Wolfertschwenden (DE)

(72) Inventors: Peter Buchberger, Waltenhofen (DE); Patrick Jung, Kempten (DE); Claudia Zellner, Memmingen (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 44 days.

(21) Appl. No.: 17/576,359

(22) Filed: Jan. 14, 2022

(65) Prior Publication Data

US 2022/0219854 A1 Jul. 14, 2022

(30) Foreign Application Priority Data

Jan. 14, 2021 (DE) ..... 102021100646.5

(51) Int. Cl.
*B65B 43/46* (2006.01)
*B65B 7/16* (2006.01)

(52) U.S. Cl.
CPC ..... *B65B 43/46* (2013.01); *B65B 7/162* (2013.01)

(58) Field of Classification Search
CPC ..... B65B 7/162; B65B 7/16; B65B 35/36; B65B 43/46; B65G 47/31
See application file for complete search history.

(56) References Cited

U.S. PATENT DOCUMENTS 5,475,965 A * 12/1995 Mondini ..... B29C 66/876 53/329.3
7,290,380 B2 * 11/2007 Natterer ..... B65B 43/48 53/485

(Continued)

FOREIGN PATENT DOCUMENTS

DE 695 05 877 T2 5/1999
DE 10 2009 017 638 A1 10/2010

(Continued)

OTHER PUBLICATIONS

European Search Report (with English Machine Translation) dated Jun. 13, 2022, Application No. 22150023.4-1014, Applicant MULTIVAC Sepp Haggenmueller SE & Co. KG, 13 Pages.

(Continued)

*Primary Examiner* — Andrew M Tecco
(74) *Attorney, Agent, or Firm* — BROOKS KUSHMAN P.C.

(57) ABSTRACT

Tray sealer, comprising a sealing station for sealing trays, an infeed belt for providing trays, an outfeed belt for transporting sealed trays away, a gripper device comprising a first gripper unit which is configured to pick up trays from the infeed belt and to position them for a sealing process within the sealing station, and comprising a second gripper unit which is configured to collect the trays sealed by way of the sealing station and to position them on the outfeed belt for being transported away, where the first gripper unit comprises a first carriage as well as a first gripper mounted thereon and the second gripper unit comprises a second carriage and a second gripper mounted thereon, a lifting mechanism for opening and closing the sealing station, as well as a control device for controlling a motion of the first carriage and the first gripper as well as for controlling a motion of the second carriage and the second gripper, where, during the opening of the lifting mechanism, the control device is configured to control a closing motion of the second gripper carried out transverse to the direction of production for collecting sealed trays from the sealing station as well as an adjusting motion of the first carriage carried out in the direction of production for supplying unsealed trays into the sealing station such that a substantially predetermined minimum distance is present between the first and the second carriage when the closing motion of the second gripper is at least substantially completed. The disclosure furthermore relates to a method for controlling a gripper device of a tray sealer.

18 Claims, 5 Drawing Sheets

(56) References Cited

U.S. PATENT DOCUMENTS

| | | | | |
|---|---|---|---|---|
| 9,162,825 | B2 * | 10/2015 | Vaccari | B65B 31/028 |
| 9,546,009 | B2 * | 1/2017 | Hagelqvist | B65B 31/028 |
| 9,650,165 | B2 * | 5/2017 | Gabler | B65B 43/46 |
| 11,401,067 | B2 * | 8/2022 | Gabler | B65B 57/04 |
| 2011/0072764 | A1 * | 3/2011 | Daniek | B26D 7/2614 53/556 |
| 2020/0346804 | A1 * | 11/2020 | Gabler | B65B 43/52 |

FOREIGN PATENT DOCUMENTS

| | | | |
|---|---|---|---|
| DE | 10 2018 215 914 | A1 | 3/2020 |
| DE | 10 2019 206 345 | A1 | 11/2020 |
| WO | 2020/188238 | A1 | 9/2020 |

OTHER PUBLICATIONS

German Search Report dated Aug. 27, 2021, Application No. 10 2021 100 646.5, Applicant MULTIVAC Sepp Haggenmueller SE & Co. KG, 6 Pages.

* cited by examiner

GRIPPER CARRIAGE CONTROL

CROSS-REFERENCE TO RELATED APPLICATIONS

This application claims foreign priority benefits under 35 U.S.C. § 119(a)-(d) to German patent application number DE 10 2021 100 646.5, filed Jan. 14, 2021, which is incorporated by reference in its entirety.

TECHNICAL FIELD

The present disclosure relates to a tray sealer with a gripper device. The disclosure furthermore relates to a method for controlling a gripper device of a tray sealer.

BACKGROUND

DE 10 2018 215 914 A1 discloses a packaging machine comprising a sealing station, an infeed conveyor, an outfeed conveyor, a control system, and a gripper system. The gripper system comprises a first and a second gripper that can each be displaced along a direction of transport. Each gripper in turn comprises at least two gripper arms which can move relative to one another for opening and closing the gripper. The first gripper is configured to move one or more packaging trays from the infeed conveyor into the sealing station, and the second gripper is configured to move one or more packaging trays from the sealing station to the outfeed conveyor and place them thereonto. The control system of the packaging machine is configured to move the first gripper independently of the second gripper. It is also possible that gripping and/or moving the first and/or the second gripper takes place at least in phases simultaneously with opening and/or closing the sealing station. Although the independent operation of the first and the second gripper presently described is advantageous, there is still sufficient potential for improvement with regard to transporting sealed trays away from sealing station and with regard to transporting unsealed trays into the sealing station in order to perform a tray change as quickly as possible at the sealing station.

SUMMARY

The object of the disclosure is to provide a tray sealer with an increased cycle rate.

The tray sealer according to the disclosure comprises a sealing station for sealing trays, an infeed belt for providing trays, an outfeed belt for transporting sealed trays away, and a gripper device. The gripper device comprises a first gripper unit which is configured to pick up trays from the infeed belt and to position them for a sealing process within the sealing station. Furthermore, the gripper device comprises a second gripper unit which is configured to collect the trays sealed by way of the sealing station and to position them on the outfeed belt for being transported away. The first gripper unit comprises a first carriage as well as a first gripper mounted thereon, and the second gripper unit comprises a second carriage and a second gripper mounted thereon. The tray sealer further comprises a lifting mechanism for opening and closing the sealing station and a control device for controlling a motion of the first carriage and the first gripper as well as for controlling a motion of the second carriage and the second gripper.

The control device is configured according to the disclosure to control a closing motion of the second gripper carried out transverse to the direction of production for collecting sealed trays from the sealing station as well as an adjusting motion of the first carriage in the direction of production for supplying unsealed trays into the sealing station when the lifting mechanism opens such that a substantially predetermined minimum distance is present between the first and the second carriage when the closing motion of the second gripper is at least substantially completed.

In the disclosure, at least the closing motion of the second gripper carried out transverse to the direction of production, the adjusting motion of the first carriage carried out in the direction of production, and the sealing station opening can be coordinated by the control device such that the first carriage of the first gripper unit and the second carriage of the second gripper unit are moved towards each other substantially to a maximum at a point in time when the closing motion of the second gripper is at least substantially completed, i.e., the two carriages have a predetermined minimum distance from each other in the direction of production. This ensures that the first gripper unit is already moved adjusted towards the sealing station when the sealed trays have been picked up by way of the second gripper, i.e., at a point in time when the trays have been received in the second gripper, so that the tray exchange at the sealing station can be performed within the shortest possible time. As a result, the time during which the sealing station is open can also be reduced, whereby the overall quality of the products to be manufactured can be improved and the machine throughput, i.e., the cycle rate, can also be increased.

One variant provides that the control device is configured to calculate the minimum distance between the first and the second carriage from the respective travel profiles held available for the first carriage, the first gripper, the second carriage, and/or the second gripper, based on which (minimum distance) a starting time can be determined for the respective travel profiles of the first carriage, the first gripper, the second carriage, and/or the second gripper with regard to their predetermined starting position. it can be achieved by this sequence control that the minimum distance is always present when the two gripper units at the sealing station are moved to a maximum towards one another.

With regard to a minimum distance, selectable preferably directly at the tray sealer, which is to be maintained between the first and second carriage as a safety distance, a relatively sophisticated variant provides that the control device is configured to provide at least one set of possible travel profiles for the first carriage, the first gripper, the second carriage, and/or the second gripper which can be displayed to an operator for selection, for example, on a display.

It is conceivable that the respective travel profiles for the first carriage, the first gripper, the second carriage, and/or the second gripper can be detected per work cycle of the sealing station and the control device is configured to calculate from the respectively detected travel profiles provided to the latter the minimum distance between the first and the second carriage, based on which (minimum distance) a starting time for the respective travel profiles of the first carriage, the first gripper, the second carriage and/or the second gripper can be determined with regard to their predetermined starting position. As a result, the cycle rate of the tray sealer can be optimized with regard to the sequence actually measured.

The control device is preferably configured to control the closing motion of the second gripper and the adjusting motion of the first carriage carried out in the direction of production such that the predetermined minimum distance is present between the first and the second carriage when the first carriage is adjusted to a maximum in the direction of production. In this variant, the second carriage of the second gripper unit has already moved in the direction of production out of a region of the sealing station further in the direction of the outfeed belt, where the first carriage of the first gripper unit is moved to a maximum into the region of the sealing station for the delivery of trays picked up thereon. In other words, the first and the second carriage are moved towards one another such that a distance present between them when the second carriage moves out of the sealing station and when the first carriage moves into the sealing station can be reduced gradually until the first carriage arrives at its end position that it can move to in the direction of production. In terms of magnitude, an acceleration of the first carriage when moving into the sealing station is greater than a simultaneous acceleration of the second carriage when moving out of the sealing station. Such movement to the predetermined minimum distance between the first and the second carriage temporally coordinated by the control device provides an advantageous collision protection between the two gripper units, because, when the minimum distance presently described has been reached at the point in time when an adjusting motion of the first carriage has been carried out to a maximum in the direction of production, the second carriage of the second gripper unit then moves further away therefrom for transferring the sealed trays to the outfeed belt.

One variant provides that the control unit is configured to control the closing motion of the second gripper and the adjusting motion of the first carriage carried out in the direction of production such that the predetermined minimum distance is present between the first and the second carriage when the second carriage begins to move in the direction of production. In this embodiment, the first gripper unit with the trays picked up thereon has already moved to a maximum towards the sealing station, i.e., is positioned at a predetermined minimum distance from the second carriage when the second carriage begins to move in the direction of production in order to transport the sealed trays picked up at the second gripper out of the sealing station. In this variant, the predetermined minimum distance between the first and the second carriage has therefore already been established at a point in time at which the second gripper unit has indeed picked up the sealed trays for transporting them out of the sealing station, but has not yet left the region of the sealing station, while the first gripper unit has moved towards the sealing station, but has not yet moved into the region of the sealing station.

The control device is preferably configured to control the opening of the lifting mechanism, the closing motion of the second gripper, and the adjusting motion of the first carriage carried out in the direction of production such that the predetermined minimum distance is present between the first and the second carriage when the second carriage has reached an end position in a direction opposite to the direction of production. In this variant, the first and the second carriage move towards each other at the same time to reach the minimum distance until the second carriage has arrived in its end position in a direction opposite to the direction of production. The first carriage has then already moved towards the sealing station in the direction of production, i.e., in the direction opposite to the motion of the second carriage, to such an extent that the predetermined minimum distance between the two carriages is present. Opening the lifting mechanism, collecting sealed trays, and transferring unsealed trays to the sealing station can then be further optimized temporally to achieve an increased cycle rate.

The control device is preferably configured to control the closing motion of the second gripper and the adjusting motion of the first carriage carried out in the direction of production such that the first and the second carriage accelerate at least temporarily with the same magnitude with opposite signs when the second gripper is adjusted to a maximum transverse to the direction of production. This means that the first carriage decelerates when it approaches the sealing station, while the second carriage at the same time accelerates out of the sealing station in order to vacate the region within the sealing station for the transfer of unsealed trays by way of the first gripper unit.

The control device is preferably configured to control the adjusting motion of the first carriage carried out in the direction of production such that a distance between the first and the second carriage can be changed. In other words, the respective adjusting motions of the first and the second carriage in the direction of production can be controlled independently of one another.

According to one embodiment, the control device is configured to control the opening of the lifting mechanism, the closing motion of the second gripper, and the adjusting motion of the first carriage carried out in the direction of production such that the predetermined minimum distance is present between the first and the second carriage when the lifting mechanism is open to a maximum. The fact that the point in time at which the predetermined minimum distance is present between the first and the second carriage coincides with the point in time at which the lifting mechanism is open to a maximum for opening the sealing station results in optimal collision protection for the transfer of unsealed trays as well as the collection of sealed trays at the sealing station.

The control device is preferably configured to set a starting time for the adjusting motion of the first carriage carried out in the direction of production per machine work cycle in dependence of the detected closing motion of the second gripper, in dependence of the detected opening motion of the lifting mechanism, and/or in dependence of a process parameter of the sealing station detected at the sealing station. A motion of the first gripper unit can then possibly be optimized per machine work cycle.

At least one sensor unit, for example a camera, can be provided at the sealing station to detect the closing motion of the second gripper, to detect the opening of the lifting mechanism, and/or to detect the process parameter of the sealing station, where in particular the starting time for the adjusting motion of the first carriage in the direction of production can be determined and controlled by way of the control device in dependence of the measurements recorded with the sensor unit. The first carriage then starts moving so early on the basis of a process progress measured at the sealing station that it reaches the predetermined minimum distance when the closing motion of the second carriage is at least substantially completed.

One variant provides that the control device is configured to determine, on the basis of a speed profile of the second carriage and/or the second gripper predetermined as a guide logic, a speed profile dependent thereon of the first carriage and/or the second gripper formed as an inference logic. The respective speed profiles can be offset with one another by way of the control device such that the predetermined minimum distance between the first and the second carriage is present when the closing motion of the second gripper is at least substantially completed.

An advantageous variant provides that the control device is configured to determine, on the basis of a speed profile of the second carriage and/or the second gripper measured as a guide logic, a speed profile dependent thereon of the first carriage and/or the second gripper formed as an inference logic. The respective speed profiles can be offset with one another by way of the control device such that the predetermined minimum distance between the first and the second carriage is present when the closing motion of the second gripper is at least substantially completed.

One embodiment of the disclosure provides that the control device is configured to determine the minimum distance on the basis of a desired tray exchange time that can be adjusted at the tray sealer and to control in dependence thereof the motions of the first and the second gripper unit. With the aid of the variably adjustable tray exchange time, it is possible to better coordinate at the tray sealer the mode of operation of the sealing station and the gripper device with other work units of the tray sealer and/or better with other work units cooperating with the tray sealer.

It is possible that the control device comprises a distance control device, where the first and/or the second gripper unit comprises at least one measuring unit for detecting a distance between the first and the second carriage, where an acceleration of the first carriage in the direction of production during the closing motion of the second gripper can be controlled in dependence of the distance detected.

The disclosure further relates to a method for controlling a gripper device of a tray sealer, where a first gripper unit by way of a first gripper formed thereon picks up trays from an infeed belt and transports them into a sealing station of the tray sealer for a sealing process, and where a second gripper unit positioned in the direction of production downstream of the first gripper unit by way of a second gripper formed thereon collects trays sealed within the sealing station and positions them on a outfeed belt for being transported away.

The disclosure provides that a control device of the tray sealer during opening of the sealing station controls a closing motion of the second gripper carried out transverse to the direction of production for collecting sealed trays from the sealing station as well as an adjusting motion of the first carriage of the first gripper unit performed in the direction of production for supplying unsealed trays into the sealing station such that a substantially predetermined minimum distance is present between the first carriage of the first gripper unit and a second carriage of the second gripper unit in the direction of production when the closing motion of the second gripper is substantially completed.

In the disclosure, a closing motion of the second gripper transverse to the direction of production together with an adjusting motion of the first carriage in the direction of production during the opening motion of the sealing station takes place temporally coordinated with one another such that the first and the second gripper unit have moved substantially to a maximum distance towards one another for a tray exchange in order to shorten the time of the tray exchange, i.e., the time to collect sealed trays from the sealing station and to deliver unsealed trays to the sealing station. This entails that the sealing station can close again as quickly as possible due to the shortened tray exchange time in order to seal trays therein picked up by the first gripper unit.

BRIEF DESCRIPTION OF THE DRAWINGS

Advantageous embodiments of the disclosure shall be explained with reference to the following figures.

Same components are provided with the same reference characters throughout the figures.

DETAILED DESCRIPTION

Figure 1:
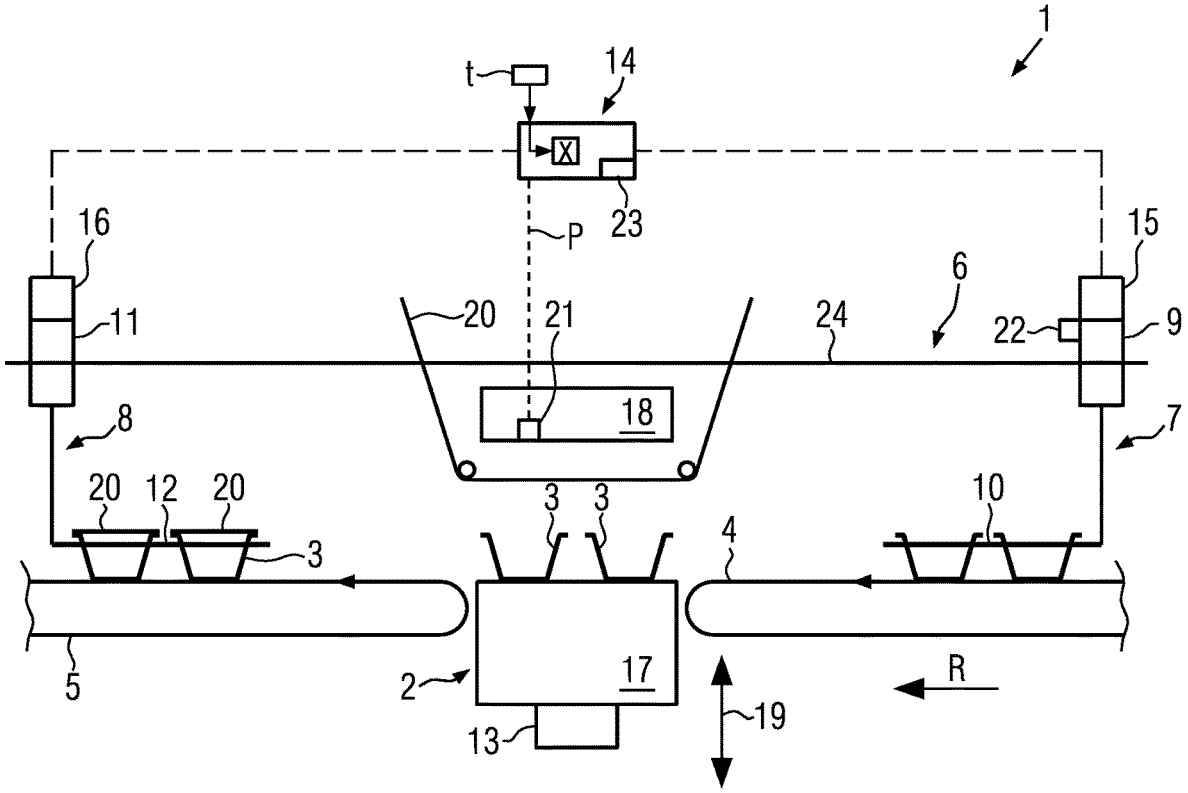
FIG. 1 shows a schematic representation of a tray sealer according to the disclosure.

FIG. 1 shows a schematic representation of a tray sealing machine 1. Such a tray sealing machine 1 is also referred to as a tray sealer. Tray sealer 1 comprises a sealing station 2 for sealing trays 3. Furthermore, tray sealer 1 comprises an infeed belt 4 for providing trays 3 and an outfeed belt 5 for transporting sealed trays 3 away.

Tray sealer 1 shown in FIG. 1 comprises a gripper device 6 with a first gripper unit 7 and with a second gripper unit 8. First gripper unit 7 is configured to pick up unsealed trays 3 from infeed belt 4 and to position them for a sealing process within sealing station 2. Second gripper unit 8 is configured to collect trays 3 sealed by way of sealing station 2 and to position them on outfeed belt 5 for being transported away. First gripper unit 7 comprises a first carriage 9 as well as a first gripper 10 mounted thereon in an adjustable manner. Second gripper unit 8 comprises a second carriage 11 and a second gripper 12 mounted thereon in an adjustable manner.

Tray sealer 1 from FIG. 1 furthermore disposes of a lifting mechanism 13 for opening and closing sealing station 2. FIG. 1 further shows a control device 14 for controlling a motion of first carriage 9 and first gripper 10 as well as for controlling a motion of second carriage 11 and second gripper 12. Control device 14 is functionally connected to a first drive 15 of first gripper unit 7 as well as functionally connected to a second drive 16 of second gripper unit 8. Control device 14 is configured to control first and second drive 15, 16 independently of one another. The control device can be configured in particular to control respective carriages 9, 11 of first and second gripper unit 7, 8 such that they move towards or away from one another while sealing station 2 is supplied with trays 3 or sealed trays 3 are transported thereoutof, respectively.

Tray sealer 1 comprises a tool lower part 17 and a tool upper part 18 arranged thereabove for a sealing process. According to FIG. 1, tool lower part 17 is mounted to be adjustable in height by way of lifting mechanism 13. The adjustability in height of tool lower part 17 is shown by way of double arrow 19. For the sealing process, tool lower part 17 can be raised to tool upper part 18 positioned thereabove in order to seal trays 3 placed on tool lower part 17 with a top film 20 passed through sealing station 2. According to FIG. 1, a sensor unit 21 is provided at sealing station 2 and is configured to detect at least one process parameter during the sealing process at sealing station 2.

According to FIG. 1, a measuring unit 22 is provided on first carriage 9 of first gripper unit 7 and is configured to detect a distance between first and second carriage 9, 11. This distance can be transmitted to a distance control device 23 of control device 14, based on which control device 14 controls a closing motion and/or an adjusting motion of first and/or second gripper unit 7, 8.

Furthermore, FIG. 1 shows that control device 14 can be assigned a desired tray exchange time t, on the basis of which control device 14 can determine a minimum distance x between first and second carriage 9, 11. Based on the predetermined minimum distance x, first and second gripper unit 7, 8 can be moved into and out of sealing station 2 for a tray exchange.

Respective carriages 9, 11 of first and second gripper units 7, 8 can be adjusted in direction of production R along a guide 24. FIG. 1 shows that first gripper unit 7 transports trays 3 in direction of production R from infeed belt 4 into sealing station 2 and second gripper unit 8 transports sealed trays 3 out of sealing station 2 and transfers them to outfeed belt 5.

Control device 14 shown in FIG. 1 is configured to control both a closing motion S (see FIG. 3A) of second gripper 12 carried out transverse to direction of production R while lifting mechanism 13 opens, i.e., while sealing station 2 opens, for collecting sealed trays 3 from sealing station 2 as well as an adjusting motion V of first carriage 9 carried out in direction of production R for supplying unsealed trays 3 into sealing station 2 such that the predetermined minimum distance x (see FIG. 3B) is substantially present between first and seconds gripper 9, 10 when closing motion S of second gripper 12 is at least substantially completed.

According to the following embodiments, closing motion S and adjusting motion V can be controlled differently by way of control device 14.

Figure 2A:
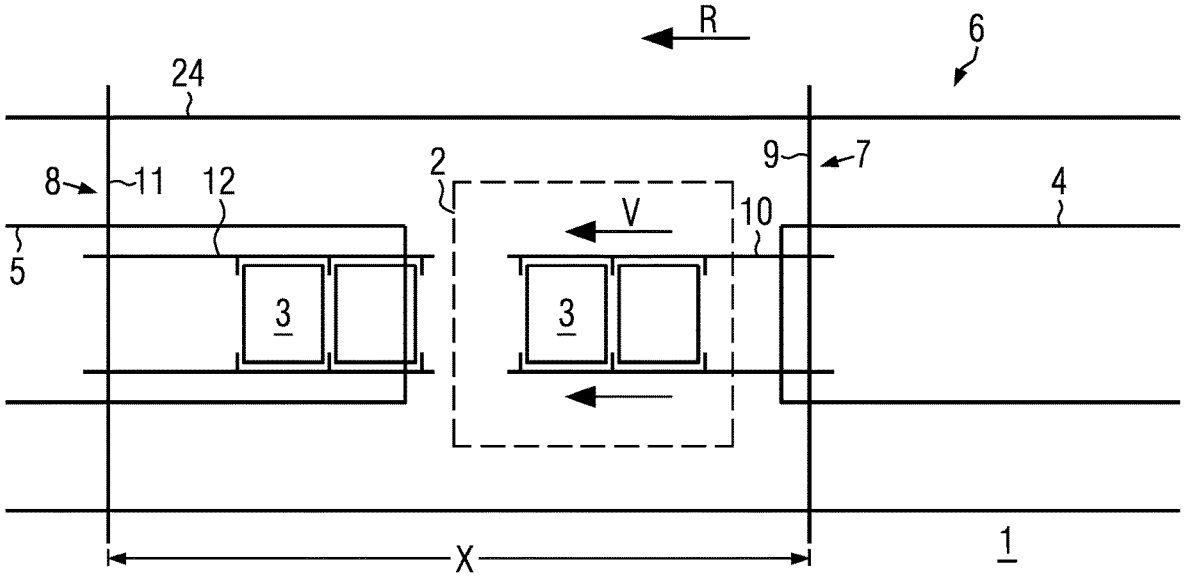
FIG. 2A shows a snapshot of a gripper device for moving to a predetermined minimum distance.

FIG. 2A shows a variant in which control device 14 controls closing motion S of second gripper 12 and adjusting motion V of first carriage 9 carried out in direction of production R such that predetermined minimum distance x is present between first and second carriage 9, 11 when first carriage 9 has been adjusted to the maximum in direction of production R. At this point in time, second gripper 12 has already left sealing station 2 to position sealed trays 3 picked up thereon onto outfeed belt 5. According to FIG. 2A, minimum distance x between first and second carriage 9, 11 has been reached when first carriage 9 is adjusted to the maximum in direction of production R, i.e., first gripper 10 is opened for transferring trays 3 picked up thereon to tool lower part 17 of sealing station 3.

Figure 2B:
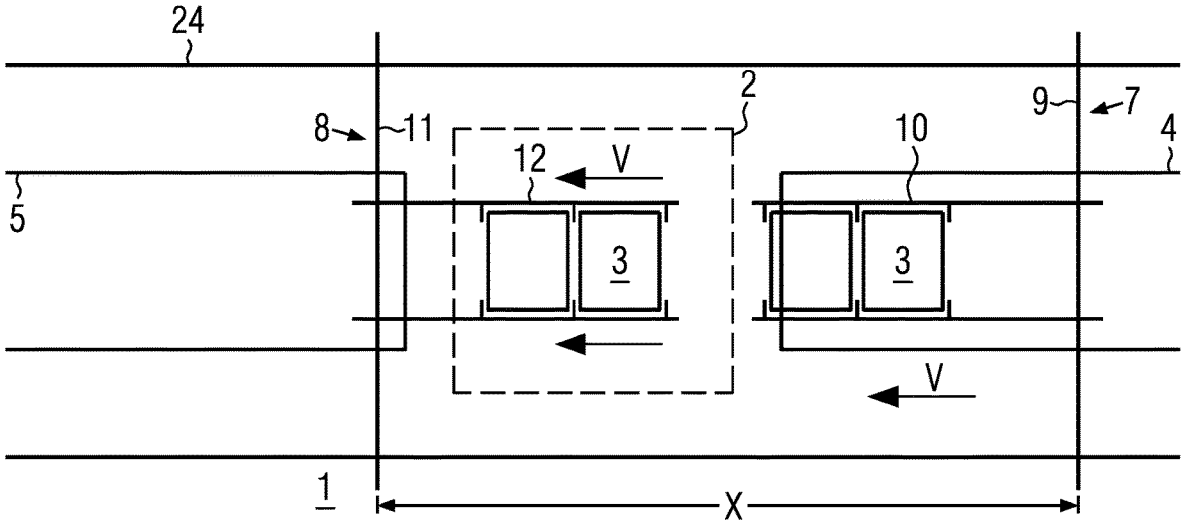
FIG. 2B shows a further snapshot of a gripper device for moving to a predetermined minimum distance.

FIG. 2B shows a variant according to which control device 14 is configured to control closing motion S of second gripper 12 and adjusting motion V of first carriage 9 carried out in direction of production R such that predetermined minimum distance x is present between first and second carriage 9, 11 when second carriage 11 begins to move in direction of production R. In this variant, minimum distance x between first and second carriage 9, 11 has been reached when sealed trays 3 are picked up by way of second gripper unit 8 and first gripper unit 7 has moved towards sealing station 2 to a maximum, but does not yet project thereinto. Unlike in FIG. 2A, minimum distance x according to FIG. 2B has therefore already been reached before first carriage 9 has reached its end position in direction of production R.0}

FIGS. 3A to 3D show a motion of the gripper device 6 for transporting trays along tray sealer 1.

Figure 3A:
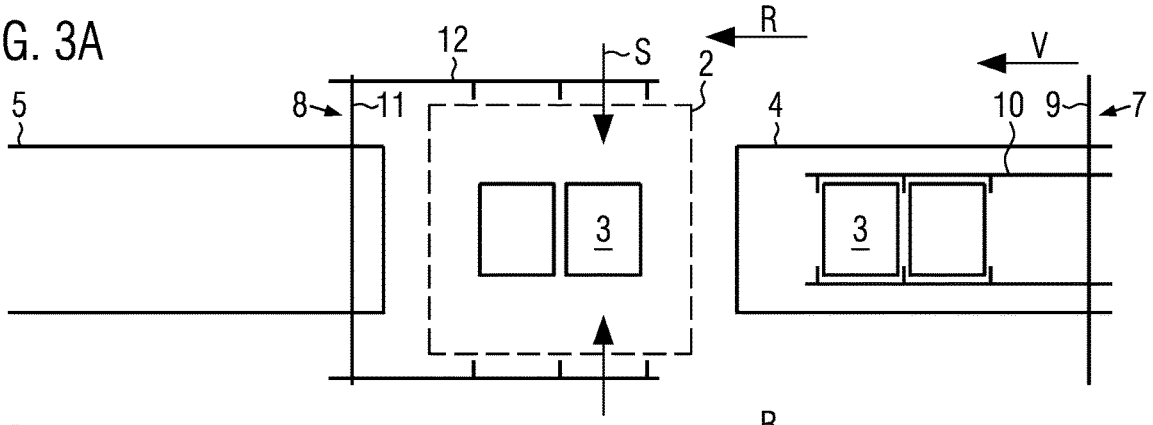
FIGS. 3A-3D show a schematic representation of adjusting motions of the gripper device.

FIG. 3A shows gripper device 6 in an initial situation. During the opening motion of mechanism 13, both a closing motion S of second gripper 12 carried out transverse to direction of production R to collect sealed trays 3 from sealing station 2 as well as an adjusting motion V of first carriage 9 carried out in direction of production R to supply unsealed trays 3 into sealing station 2 start in this state.

Figure 3B:
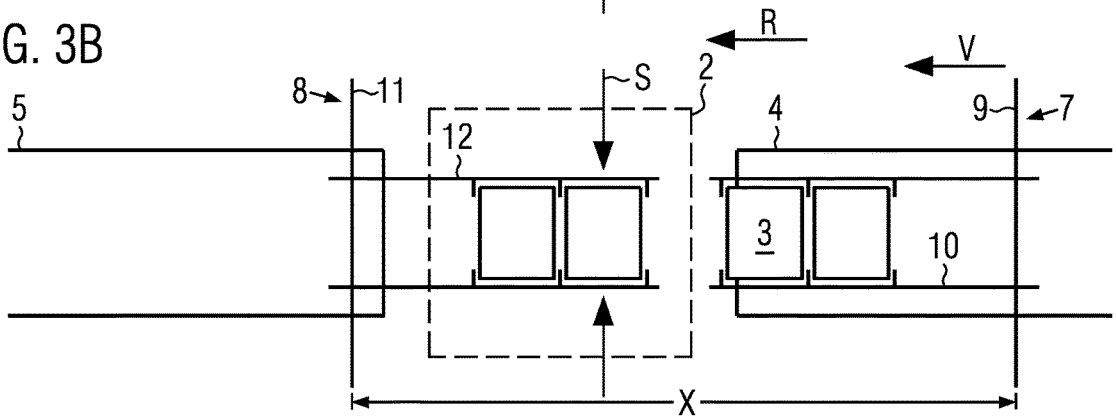

Closing motion S and adjusting motion V are controlled by way of control device 14 such that a substantially predetermined minimum distance x is present between first and second carriage 9, 11 when closing motion S of second gripper 12 is at least substantially complete. This is shown in FIG. 3B.

Figure 3C:
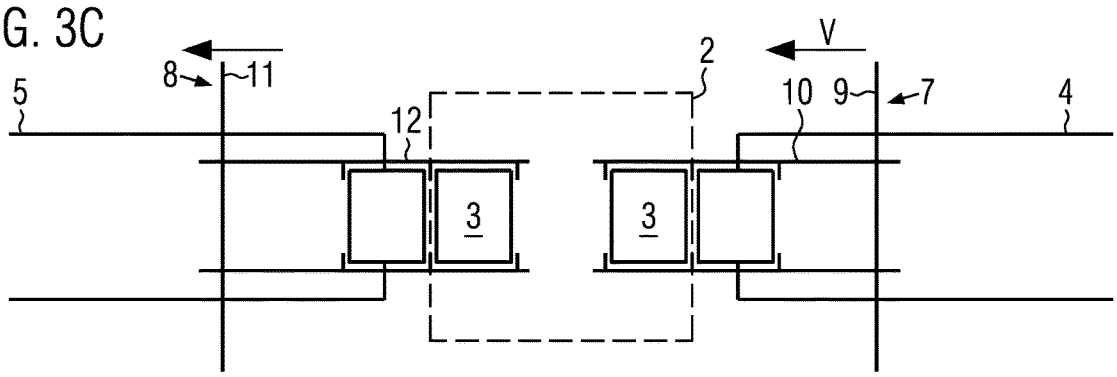

According to FIG. 3C, sealed trays 3 collected by way of second gripper unit 8 are transported in direction of production R to outfeed belt 5. At the same time, unsealed trays 3 picked up at first gripper unit 7 are transported into sealing station 2. At this point in time, two carriages 9, 11 can already again move away from one another again.

Figure 3D:
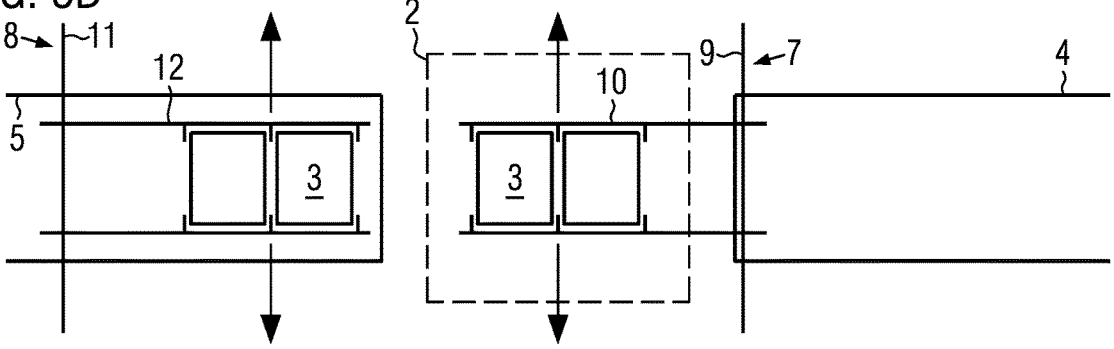

FIG. 3D shows that, by opening second gripper unit 12, sealed trays 3 picked up thereon are transferred to outfeed belt 5. At the same time or offset in time, first gripper unit 7 transfers unsealed trays 3 picked up at first gripper 10 to sealing station 2 for the sealing process.

FIGS. 3A to 3D show that minimum distance x is substantially present between first and second carriage 9, 11 when the sealed trays are picked up by way of second gripper 12, and first gripper 10 has moved substantially at a maximum distance toward opened sealing station 2.

FIGS. 4A to 4D show an alternative motion of gripper device 6 for transporting trays 3 along tray sealer 1.

Figure 4A:
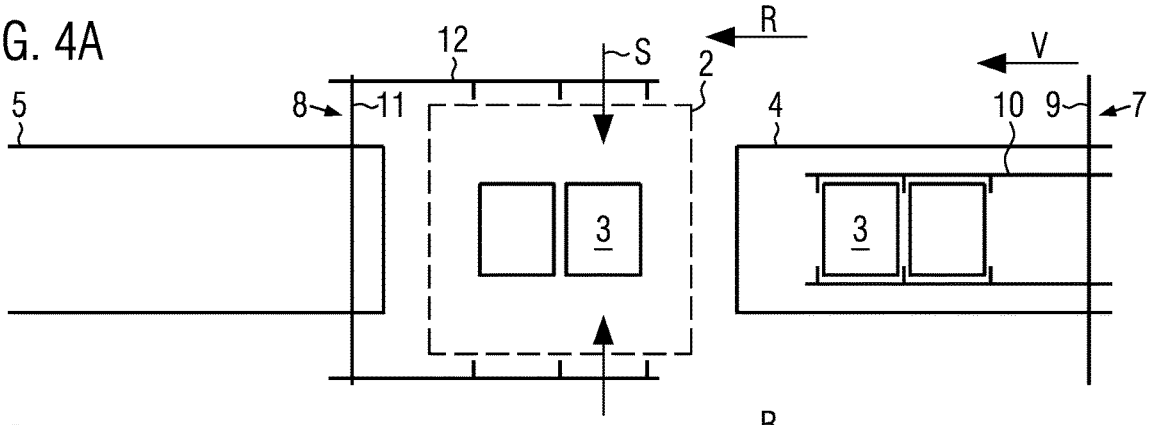
FIGS. 4A-4D show a further schematic representation of adjusting motions of the gripper device.

According to FIG. 4A, an initial situation is present in which closing motion S of second gripper 12 begins. At the same time or offset in time, first carriage 9 of first gripper unit 7 begins with an adjusting motion V in direction of production R.

Figure 4B:
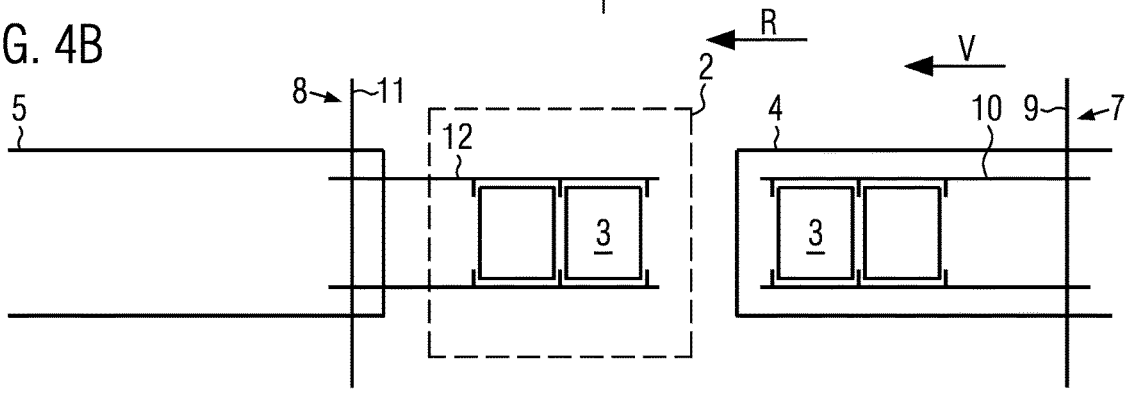

FIG. 4B shows that first gripper unit 7 has moved further in direction of production R towards sealing station 2. The trays sealed in sealing station 2 are picked up by way of second gripper unit 8 to be transported out of sealing station 2.

Figure 4C:
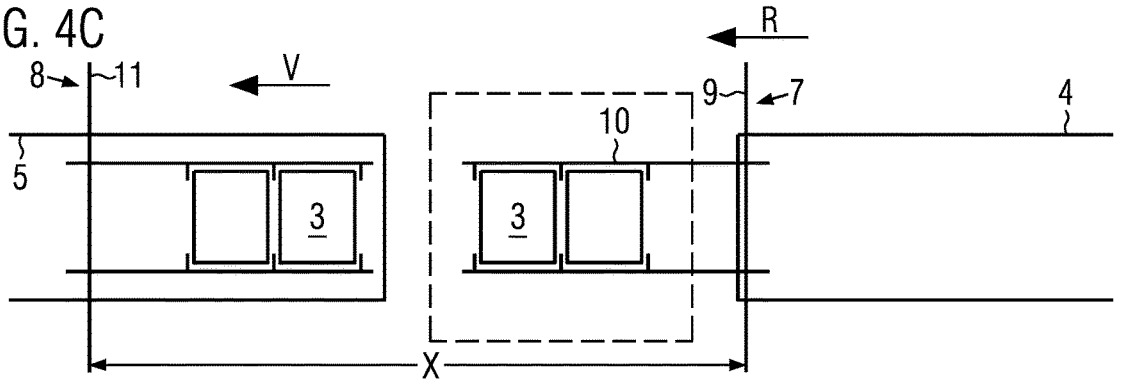

FIG. 4C now shows the point in time at which predetermined minimum distance x is present between first carriage 9 and second carriage 11. According to FIG. 4C, this is the point in time at which first carriage 9 is adjusted to a maximum in direction of production R. At this point in time, second gripper 12 has already left sealing station 2.

Figure 4D:
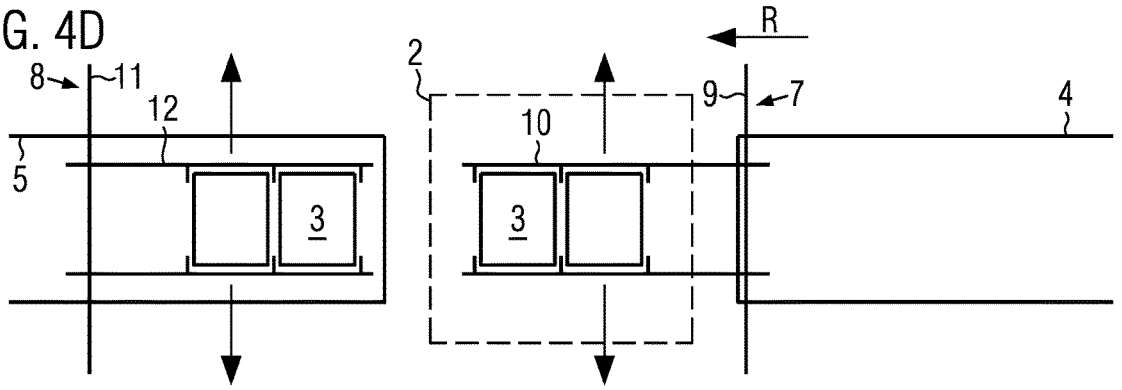

FIG. 4D shows the opening motion of two grippers 10, 12 for delivering the trays to sealing station 2 or transferring sealed trays 3 to outfeed belt 5. Two grippers 10, 12 can be opened at the same time in a manner coordinated with one another.

FIGS. 3B and 4C show different variants of how control device 14 can control minimum distance x between first carriage 9 and second carriage 11. According to FIG. 3B, minimum distance x is present when second carriage 11 begins to move in direction of production R. According to FIG. 4C, minimum distance x is present when first carriage 9 is adjusted to the maximum in direction of production R.

Figure 5A:
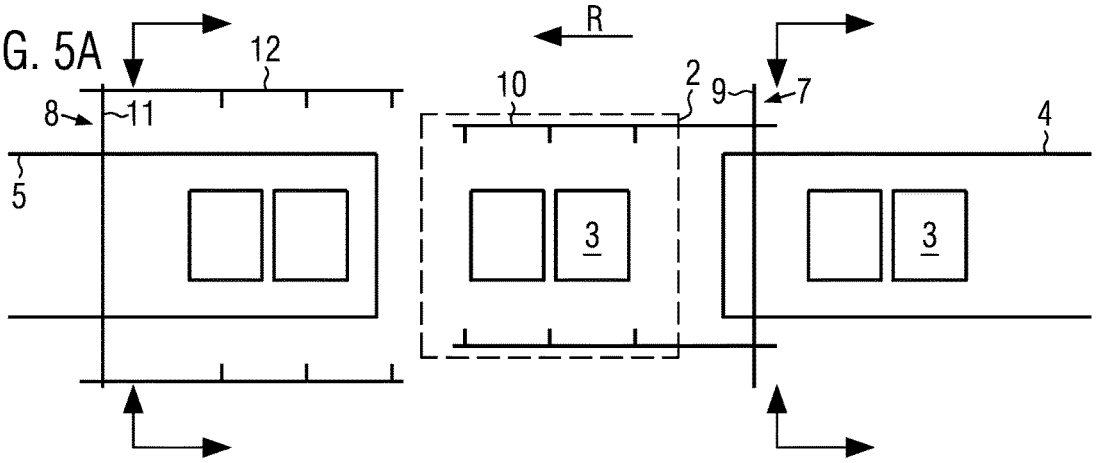
FIGS. 5A-5C show a further representation of adjusting motions of the gripper device.
Figure 5B:
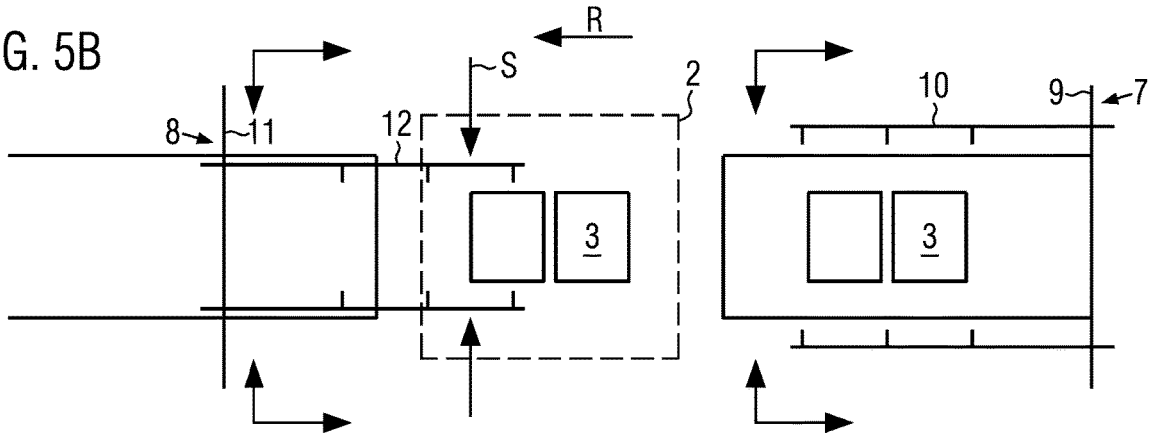
Figure 5C:
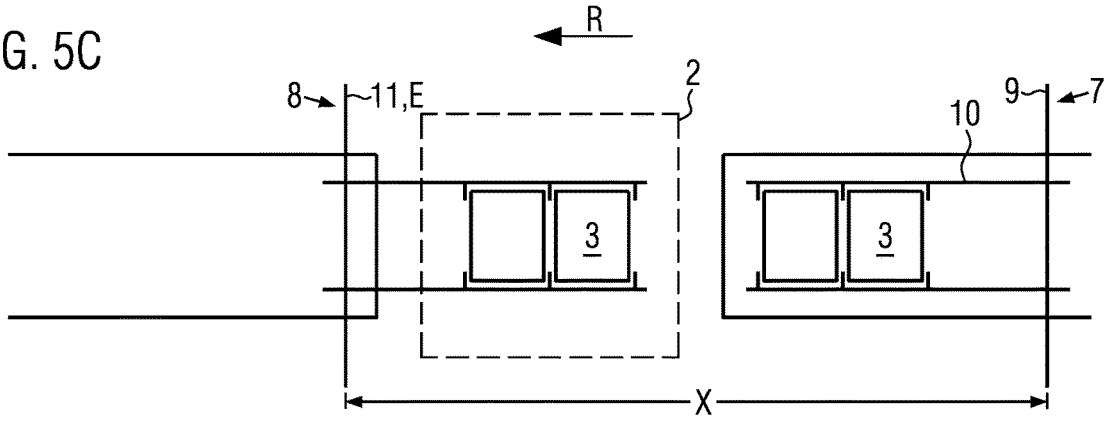

FIGS. 5A to 5C show a further variant of how the motion of gripper device 6 can be controlled by way of control device 14 for moving to a minimum distance x between first carriage 9 and second carriage 11.

FIG. 5A shows an initial situation in which second gripper unit 8 is adjusted both in a direction opposite to direction of production R as well as transverse to direction of production R. On the basis of this adjusting and closing motion at the same time, it is possible for second gripper 12 to already carry out a closing motion S transverse to direction of production R during the adjusting motion of second carriage 11 in a direction opposite to direction of production R (see FIG. 5B). Control device 14 can control the opening of lifting mechanism 13, closing motion S of second gripper 12, and the adjusting motion of second carriage 11 carried out in a direction opposite to direction of production R such that predetermined minimum distance x is present between first and second carriage 9, 11 when second carriage 11 has arrived at an end position in a direction opposite to direction of production R in accordance with FIG. 5C. At this point in time, first carriage 9 has already moved so far towards sealing station 2 that predetermined minimum distance x is present between first and second carriage 9, 11. From the initial situation in FIG. 5A, the return motion shown of first gripper unit 7, similar to the motion of second gripper unit 8, can likewise take place at the same time in a direction opposite to direction of production R and transverse to direction of production R in for collecting trays 3 provided on infeed belt 4.

What is claimed is:

1. A tray sealer comprising:

a sealing station for sealing trays;

an infeed belt for providing trays;

an outfeed belt for transporting sealed trays away; and a gripper device comprising a first gripper unit which is configured to pick up trays from the infeed belt and to position them for a sealing process within the sealing station, and comprising a second gripper unit which is configured to collect trays sealed by way of the sealing station and to position them on the outfeed belt for being transported away, where the first gripper unit comprises a first carriage as well as a first gripper mounted thereon and the second gripper unit comprises a second carriage and a second gripper mounted thereon, a lifting mechanism for opening and closing the sealing station, as well as a control device for controlling a motion of the first carriage and the first gripper as well as for controlling a motion of the second carriage and the second gripper, wherein, during an opening motion of the lifting mechanism, the control device is configured to control a closing motion of the second gripper carried out transverse to a direction of production for collecting sealed trays from the sealing station as well as an adjusting motion of the first carriage carried out in the direction of production for supplying unsealed trays into the sealing station such that a substantially predetermined minimum distance is present between the first and the second carriage when the closing motion of the second gripper is at least substantially completed.

2. The tray sealer according to claim 1, wherein the control device is configured to control the closing motion of the second gripper and the adjusting motion of the first carriage carried out in the direction of production such that that the predetermined minimum distance is present between the first and the second carriage when the first carriage is adjusted to the maximum in the direction of production.

3. The tray sealer according to claim 1, wherein the control device is configured to control the closing motion of the second gripper and the adjusting motion of the first carriage carried out in the direction of production such that that the predetermined minimum distance is present between the first and the second carriage when the second carriage begins to move in the direction of production.

4. A tray sealer according to claim 1, wherein the control device is configured to control the opening motion of the lifting mechanism, the closing motion of the second gripper, and the adjusting motion of the first carriage carried out in the direction of production such that that the predetermined minimum distance is present between the first and the second carriage when the second carriage has arrived at an end position in a direction opposite to the direction of production.

5. The tray sealer according to claim 1, wherein the control device is configured to control the closing motion of the second gripper and the adjusting motion of the first carriage carried out in the direction of production such that that the first and the second carriage accelerate at least temporarily at the same magnitude with opposite signs when the second gripper is adjusted to the maximum transverse to the direction of production.

6. The tray sealer according to claim 1, wherein the control device is configured to control the adjusting motion of the first carriage carried out in the direction of production such that a distance between the first and the second carriage can be changed.

7. The tray sealer according to claim 1, wherein the control device is configured to control the opening motion of the lifting mechanism, the closing motion of the second gripper, and the adjusting motion of the first carriage carried out in the direction of production such that that the predetermined minimum distance is present between the first and the second carriage when the lifting mechanism is open to the maximum.

8. The tray sealer according to claim 1, wherein the control device is configured to set a starting time for the adjusting motion of the first carriage carried out in the direction of production per machine work cycle in dependence of the detected closing motion of the second gripper, in dependence of the detected opening of the lifting mechanism and/or in dependence of a process parameter of the sealing station detected at the sealing station.

9. The tray sealer according to claim 1, wherein the control device is configured to determine, on the basis of a speed profile of the second carriage and/or the second gripper predetermined as a guide logic, a speed profile dependent thereon of the first carriage and/or the second gripper formed as an inference logic.

10. The tray sealer according to claim 1, wherein the control device is configured to determine the minimum distance on the basis of a desired tray exchange time that can be adjusted at the tray sealer and to control in dependence thereof the motions of the first and the second gripper unit.

11. The tray sealer according to claim 1, wherein the control device comprises a distance control device, where the first and/or the second gripper unit comprises at least one measuring unit for detecting a distance between the first and the second carriage, where an acceleration of the first carriage in the direction of production during the closing motion of the second gripper can be controlled in dependence of the distance detected.

12. A method for controlling a gripper device of a tray sealer, where a first gripper unit by way of a first gripper formed thereon picks up trays from an infeed belt and transports them into a sealing station of the tray sealer for a sealing process, and where a second gripper unit positioned in a direction of production downstream of the first gripper unit by way of a second gripper formed thereon collects the trays sealed within the sealing station and positions them on an outfeed belt for being transported away, wherein, during an opening motion of the lifting mechanism, the control device is configured to control a closing motion of the second gripper carried out transverse to the direction of production for collecting sealed trays from the sealing station as well as an adjusting motion of the first carriage of the gripper unit carried out in the direction of production for supplying unsealed trays into the sealing station such that a substantially predetermined minimum distance is present between the first carriage of the first gripper unit and a second carriage of the second gripper unit when the closing motion of the second gripper is at least substantially completed.

13. A tray sealer comprising:

a sealing station for sealing trays;

an infeed belt for providing trays;

an outfeed belt for transporting sealed trays away;

a gripper device comprising a first gripper station configured to pick up trays from the infeed belt and to position them within the sealing station for sealing, and comprising a second gripper station configured to collect trays sealed by way of the sealing station and to position them on the outfeed belt for being transported away, where the first gripper station comprises a first carriage as well as a first gripper mounted thereon and the second gripper station comprises a second carriage and a second gripper mounted thereon; and a lift for opening and closing the sealing station, and a controller for controlling motion of the first carriage and the first gripper as well as for controlling motion of the second carriage and the second gripper, wherein, during an opening motion of the lift, the controller is configured to control a closing motion of the second gripper carried out transverse to a direction of production for collecting sealed trays from the sealing station as well as an adjusting motion of the first carriage carried out in the direction of production for supplying unsealed trays into the sealing station such that a predetermined minimum distance is present between the first and the second carriage when the closing motion of the second gripper is at least substantially completed.

14. The tray sealer according to claim 13, wherein the controller is configured to control the closing motion of the second gripper and the adjusting motion of the first carriage carried out in the direction of production such that that the predetermined minimum distance is present between the first and the second carriage when the first carriage is adjusted to the maximum in the direction of production.

15. The tray sealer according to claim 13, wherein the controller is configured to control the closing motion of the second gripper and the adjusting motion of the first carriage carried out in the direction of production such that that the predetermined minimum distance is present between the first and the second carriage when the second carriage begins to move in the direction of production.

16. A tray sealer according to claim 13, wherein the controller is configured to control the opening motion of the lift, the closing motion of the second gripper, and the adjusting motion of the first carriage carried out in the direction of production such that that the predetermined minimum distance is present between the first and the second carriage when the second carriage has arrived at an end position in a direction opposite to the direction of production.

17. The tray sealer according to claim 13, wherein the controller is configured to control the closing motion of the second gripper and the adjusting motion of the first carriage carried out in the direction of production such that that the first and the second carriage accelerate at least temporarily at the same magnitude with opposite signs when the second gripper is adjusted to the maximum transverse to the direction of production.

18. The tray sealer according to claim 13, wherein the controller is configured to control the adjusting motion of the first carriage carried out in the direction of production such that a distance between the first and the second carriage can be changed.

* * * * *